US009328921B2

(12) United States Patent
Lefebvre et al.

(10) Patent No.: US 9,328,921 B2
(45) Date of Patent: May 3, 2016

(54) LIGHTER THAT INCLUDES A PIVOTING IGNITION SUBSET

(75) Inventors: Guy Lefebvre, Cannes (FR); Yann Lefebvre, Pornichet (FR)

(73) Assignee: SOCIÉTÉ BIC, Clichy (FR)

( * ) Notice: Subject to any disclaimer, the term of this patent is extended or adjusted under 35 U.S.C. 154(b) by 606 days.

(21) Appl. No.: 13/808,038

(22) PCT Filed: Jul. 1, 2010

(86) PCT No.: PCT/IB2010/002027

§ 371 (c)(1),
(2), (4) Date: Mar. 14, 2013

(87) PCT Pub. No.: WO2012/001451

PCT Pub. Date: Jan. 5, 2012

(65) Prior Publication Data

US 2013/0164698 A1 Jun. 27, 2013

(51) Int. Cl.
*F23Q 2/46* (2006.01)
*F23Q 2/16* (2006.01)

(52) U.S. Cl.
CPC ..... *F23Q 2/161* (2013.01); *F23Q 2/164* (2013.01); *F23Q 2/46* (2013.01)

(58) Field of Classification Search
CPC ..... F23Q 2/46; F23Q 2/50; F23Q 2/161; F23Q 2/164
USPC ..... 431/273–277
See application file for complete search history.

(56) References Cited

U.S. PATENT DOCUMENTS

| | | | | | |
|---|---|---|---|---|---|
| 3,063,276 | A | | 11/1962 | Cassan | |
| 3,224,235 | A | * | 12/1965 | Meylan | 431/254 |
| 3,228,215 | A | * | 1/1966 | Racek | 431/130 |
| 3,816,058 | A | | 6/1974 | Court | |
| 3,895,904 | A | * | 7/1975 | Kimball | 431/143 |
| 4,325,692 | A | * | 4/1982 | Kitabayashi | 431/254 |
| 4,457,697 | A | * | 7/1984 | Kitabayashi | 431/254 |
| 5,096,414 | A | | 3/1992 | Zellweger | |
| 5,490,773 | A | | 2/1996 | Lloveras Capilla | |
| 5,759,023 | A | | 6/1998 | Jenlis | |

(Continued)

FOREIGN PATENT DOCUMENTS

WO WO 97/01734 1/1997

OTHER PUBLICATIONS

International Search Report for PCT/IB2010/002027.

*Primary Examiner* — Jorge Pereiro
(74) *Attorney, Agent, or Firm* — Polsinelli

(57) ABSTRACT

A gas lighter that includes a reservoir for holding a flammable gas, a valve mounted on a top surface of the reservoir for allowing a release of the gas from the reservoir, a valve actuator having a push button on a first end and a connector at a second end for connecting the valve actuator to the valve; a first spring biased against a lower surface of the push button actuator and a wall of the reservoir; a spark wheel coaxially mounted with corresponding cheeks that are capable of rotating; a hood disposed completely or partially over the spark wheel and cheeks; at least two support arms, each arm having a first end coaxially mounted with the cheeks and a second end having a pivoting connection to bearings located on the reservoir; a sleeve disposed under the under the spark wheel; a second spring disposed in the sleeve; and a flint stone disposed in the sleeve.

23 Claims, 9 Drawing Sheets

(56) References Cited

U.S. PATENT DOCUMENTS

| | | | | | |
|---|---|---|---|---|---|
| 5,846,069 | A * | 12/1998 | Sher | 431/153 |
| 5,882,186 | A * | 3/1999 | Kai Man | 431/153 |
| 5,897,307 | A * | 4/1999 | Chang | 431/153 |
| 6,142,768 | A * | 11/2000 | Feng et al. | 431/153 |
| 6,146,128 | A * | 11/2000 | Feng et al. | 431/153 |
| 6,494,709 | B1 * | 12/2002 | Li | 431/153 |
| 2005/0164140 | A1 | 7/2005 | Luo | |
| 2008/0206694 | A1 * | 8/2008 | Sewalt | 431/153 |

* cited by examiner

LIGHTER THAT INCLUDES A PIVOTING IGNITION SUBSET

CROSS REFERENCE TO RELATED APPLICATION

This application is a national stage application of International Application No. PCT/IB2010/002027 filed on Jul. 1, 2010, the entire contents of this application are incorporated herein by reference.

The embodiments of the present invention relate to a gas lighter that includes a safety ignition system that is not easily usable by a young child less than five years old.

BACKGROUND OF THE EMBODIMENTS OF THE PRESENT INVENTION

A person of ordinary skill in the art will readily understand that a gas lighter generally includes a gas reservoir that contains a liquefied petroleum gas, a valve on the reservoir that allows the fuel to be emitted from the reservoir with a determined flow, a system of opening and closing of the valve as well as an ignition system. A lighter known in the art typically includes a pyrophoric stone flint that cooperates with a spark wheel to produce sparks that light the gas emitted from the reservoir. The spark wheel is typically assembled on an axis between two cheeks attached to the axis, and both are generally protected by a hood. The spark wheel typically has a cylindrical shape and the cheeks have a shape of a disc having an external diameter appreciably higher than that of the spark wheel. The periphery of the cheeks typically includes asperities making the surface rough. Therefore, a user can easily actuate the spark wheel with a finger, for the finger does not slip on the cheeks.

A person of ordinary skill in the art will also readily understand that for a gas lighter having the features described above, when the spark wheel, in contact with the stone, is put in rotation by the intermediary of the cheeks and the finger of the user, a shower of sparks is created and followed, by the action of this same finger on the fork of opening of the gas (referred to in the art as the "roll and press" system), of a release of a quantity of gas. The shower of sparks ignites gas then by producing a flame above the hood. A typical lighter as described above therefore only requires a positive action from the user to produce and maintain a flame and requires only one tangential movement starting the rotation of the spark wheel in a first step, and then ending in an action on the gas opening fork to produce a flame. There have been efforts to increase the difficulty of using such lighters so that children less than five years old cannot produce flames using the lighters as described above. For example, WO 97/01734 describes a lighter that uses smooth cheeks to make it more difficult for children to rotate the cheeks. Similarly, U.S. Pat. No. 5,096,414 ("the '414 patent"), is directed to a lighter that includes a striker wheel 6 disposed between two plates 7, 8 that have a greater diameter and are freely rotatable with respect to the striker wheel 6. In the '414 patent, a user actuates the striker wheel 6 by friction thanks to the deformation 11 of the pulp of the thumb 10 of the user, i.e., children are not able to similarly actuate the lighter because the pulp of their fingers is not sufficiently thick.

Other U.S. patents disclose childproof mechanisms to make it more difficult for children to use them. For example, U.S. Pat. No. 5,490,773 is directed to a "Pocket Lighter" and includes features directed to a spark wheel's rotary shaft that is capable of being disposed in first and second positions in the housing (see FIG. 1, reference numerals 12 and 13) where the first position shown in FIG. 8 causes the spark wheel to be blocked from turning and the second position shown in FIG. 9 allows the spark wheel to be unblocked to allow it to strike the flint to cause the required sparking. In addition, U.S. Pat. No. 5,971,748, is directed to a "Gas Safety Lighter Comprising a Pyrophoric Flint and Spark Wheel Ignition System" and includes features related to an axis of a valve lever mounted movably with respect to the body of the lighter between an active position (shown in FIG. 8) permitting the operation of the valve mounted on the reservoir and a rest position (shown in FIG. 5) in which action on the lever does not permit operation of the valve.

The lighters described above and in related prior art references require an additional device to inhibit access to the cheeks of the spark wheel, they render the driving of the spark wheel to be more difficult, they block the movement of the gas opening fork, and the parts of the ignition system and gas opening system are usually visible by and accessible by children. These lighters typically have a complex structure that lead to high manufacturing costs. Moreover, the use of some of these lighters is difficult or complicated even for adults.

At least for these reasons, there is a need for a lighter that is easily usable by an adult, but more difficult to use by a child such as a lighter having a pivoting ignition subset as described in more detail below.

SUMMARY OF THE PRESENT INVENTION

It is an object of the present invention to provide a lighter having a reliable but safe ignition system.

It is another object of the present invention to provide a lighter that operates as close as possible to traditional lighters by first carrying out the action of unlocking the lighter, which in the case of an embodiment of the present invention, includes extracting the spark wheel out of the hood, at the same place as the action of lighting the lighter so that the user does not need instructions to use the lighter.

It is still another object of the present invention to provide a lighter of which a part integrating the functions of lighting and gas opening constitutes a single subset being capable of assembly prior to and apart from the final assembly of the lighter.

An embodiment of the present invention is directed to a gas lighter that includes a reservoir for holding a flammable gas, a valve mounted on a top surface of the reservoir for allowing a release of the gas from the reservoir, a valve actuator having a push button disposed on a first end and a connection assembly disposed on a second end for connecting the valve actuator member to the valve, a first spring biased against a lower surface of the push button and a wall of the reservoir, a spark wheel coaxially mounted with at least two cheeks capable of rotating, a hood disposed completely or partially over the cheeks, at least two support arms, each arm having a first end coaxially mounted with the cheeks and a second end having a pivoting connection to bearings disposed on the reservoir, a sleeve orthogonally disposed under the under the spark wheel, a second spring disposed in the sleeve and a flint stone disposed in the sleeve, on a top surface of the second spring.

Another embodiment of the present invention is directed to a gas lighter that includes a reservoir for holding a flammable gas, a valve mounted on a top surface of the reservoir for allowing a release of the gas from the reservoir, a valve actuator having a push button disposed on a first end and a connection assembly disposed on a second end for connecting the valve actuator to the valve, a first spring biased against a lower surface of the push button and a wall of the reservoir, a spark wheel coaxially mounted with at least two cheeks capable of rotating, a hood disposed completely over the cheeks, at least two support arms, each arm having a first end coaxially mounted with the cheeks and a second end having a pivoting connection to bearings disposed on the reservoir, a sleeve orthogonally disposed under the under the spark wheel, a second spring disposed in the sleeve and a flint stone disposed in the sleeve, on a top surface of the second spring.

An embodiment of the present invention is directed to a gas lighter that includes a reservoir for holding a flammable gas, a valve mounted on a top surface of the reservoir for allowing a release of the gas from the reservoir, a valve actuator having a push button disposed on a first end and a connection assembly disposed on a second end for connecting the valve actuator to the valve, a first spring biased against a lower surface of the push button and a wall of the reservoir, a spark wheel coaxially mounted with at least two cheeks capable of rotating, a hood disposed completely or partially over the cheeks, at least two support arms, each arm having a first end coaxially mounted with the cheeks and a second end having a pivoting connection to bearings disposed on the reservoir, a sleeve orthogonally disposed under the under the spark wheel, a second spring disposed in the sleeve, and a flint stone disposed in the sleeve, on a top surface of the second spring, where when the lighter is in operation from an initial rest position to a final lighting position, the entire lighting and valve opening subset as shown at least in FIGS. 4A, 4B, 5A and 5B including the spark wheel, cheeks and sleeve rotate relative to the reservoir.

DETAILED DESCRIPTION OF THE EMBODIMENTS OF THE PRESENT INVENTION

Figure 2:
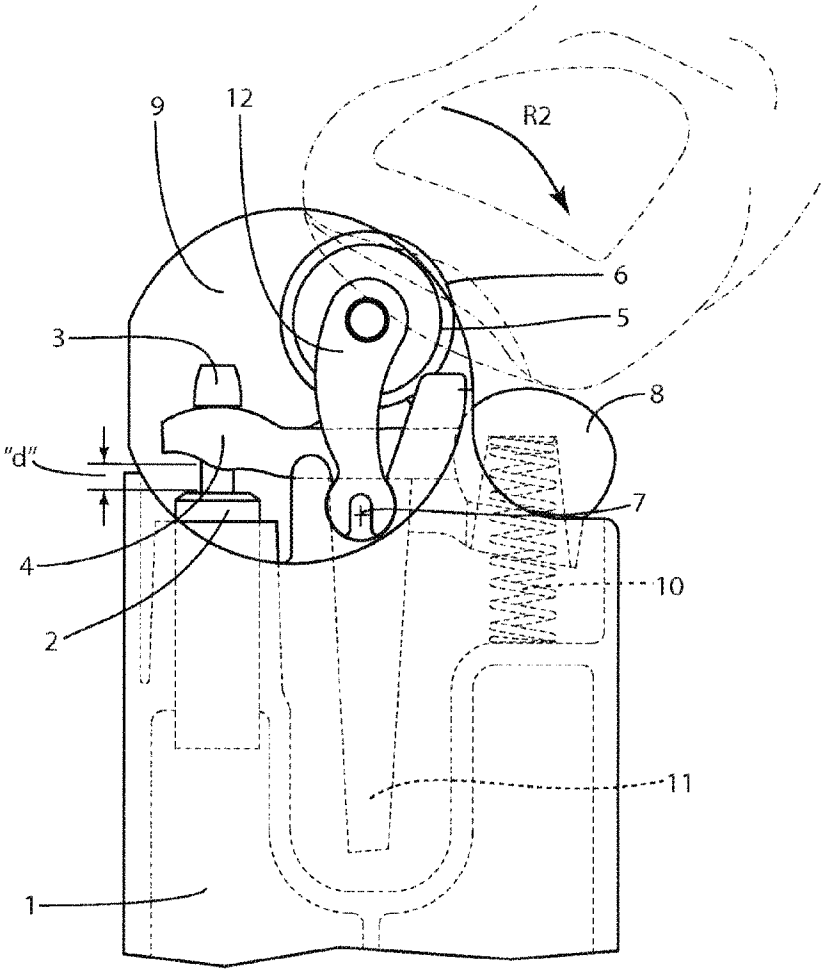
FIG. 2 shows a side view of a lighter according to a first embodiment of the present invention where the lighter is in its intermediate position in the course of lighting.

With references to the drawings, and as understood by a person of ordinary skill in the art, a lighter shown in FIGS. 1-8 above includes a reservoir 1 that contains a liquefied petroleum gas and a valve 2 mounted on preferably a top surface of the reservoir 1 for allowing gas to be emitted from the reservoir 1. The lighter also includes a flint stone 15 that cooperates with a spark wheel 5 that is turned either directly or by a least a cheek 6 connected coaxially to the spark wheel 5. The embodiments of the present invention as described further below include an ignition system and gas opening system that are capable of moving relative to the reservoir 1, are capable of swiveling about an axis 7 and are independent of the gas reservoir.

Figure 1:
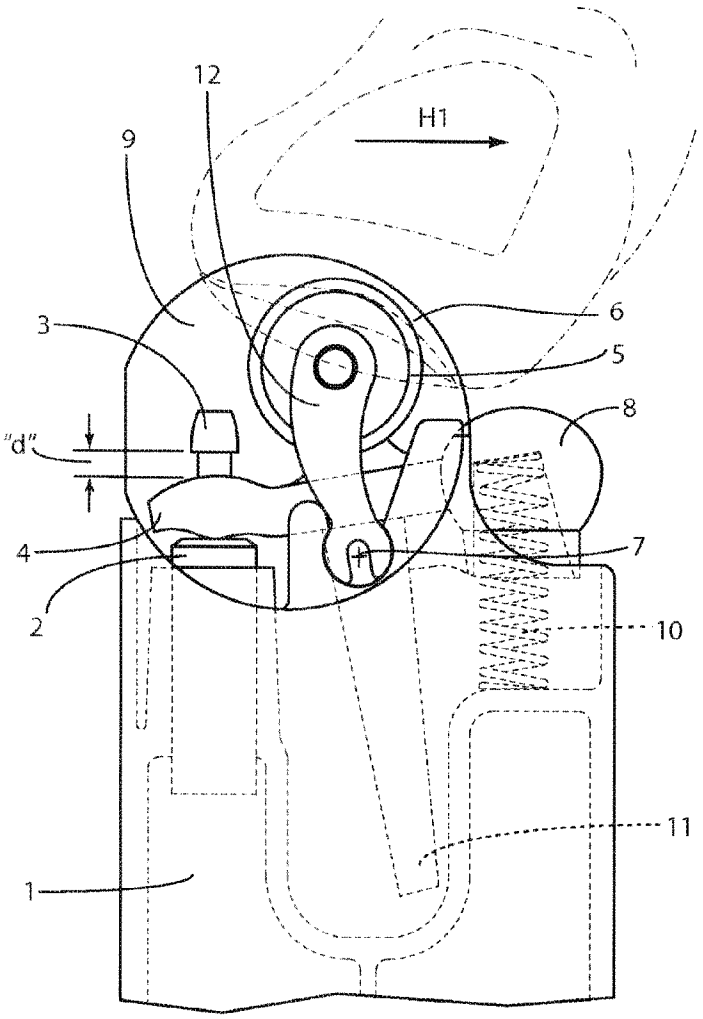
FIG. 1 shows a side view of a lighter according to a first embodiment of the present invention where the lighter is in its rest position and the spark wheel is inside the hood.
Figure 3:
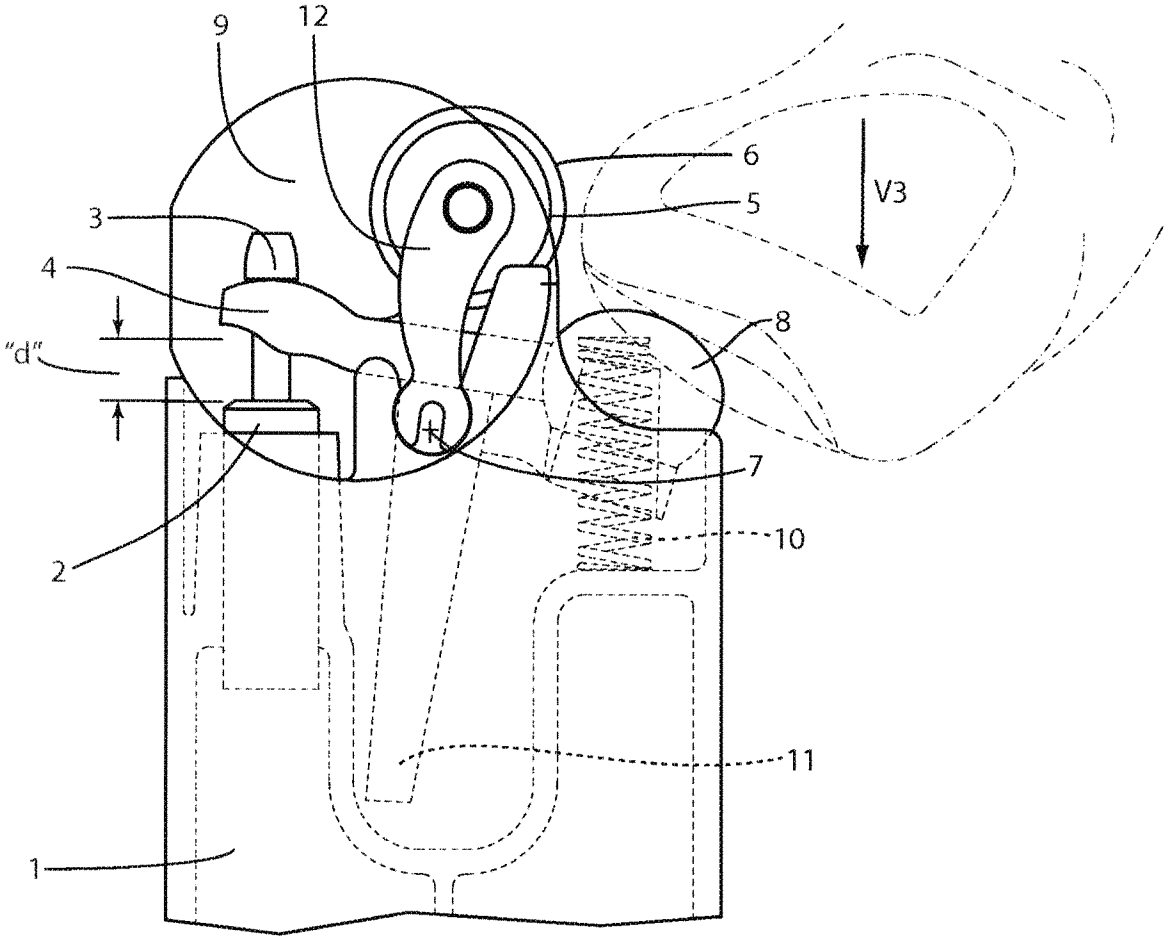
FIG. 3 shows a side view of a lighter according to a first embodiment of the present invention where the lighter is in its final position in the course of lighting, where the action of the thumb maintains the flame after lighting.
Figure 4B:
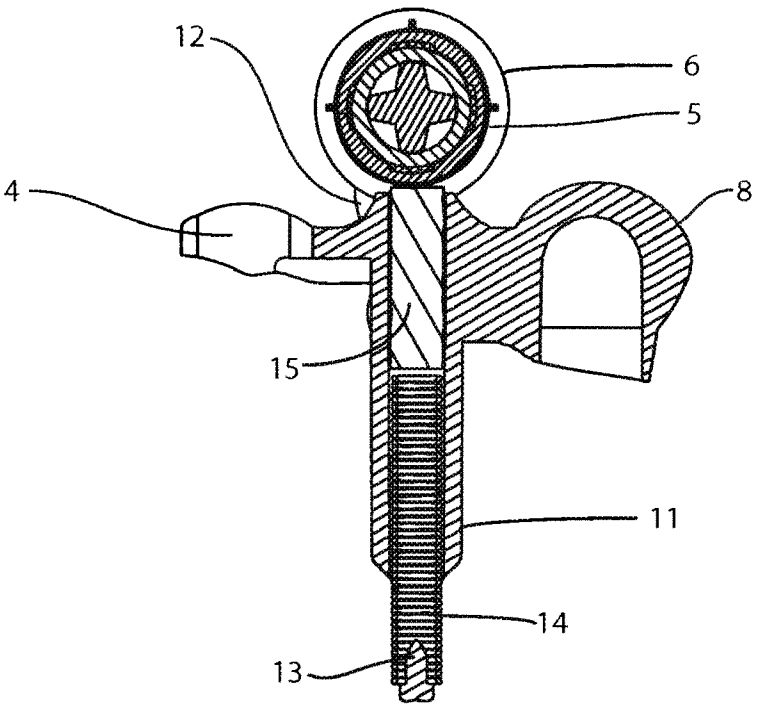
FIG. 4B shows a cross-sectional side view of the lighting and valve opening subset according to a first embodiment of the present invention.
Figure 4A:
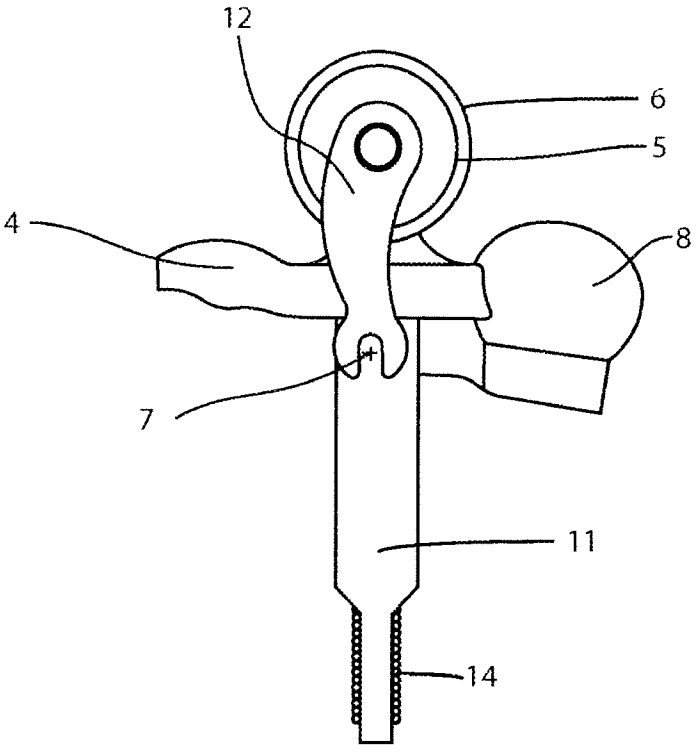
FIG. 4A shows an external side view of the lighting and valve opening subset according to a first embodiment of the present invention.
Figure 5A:
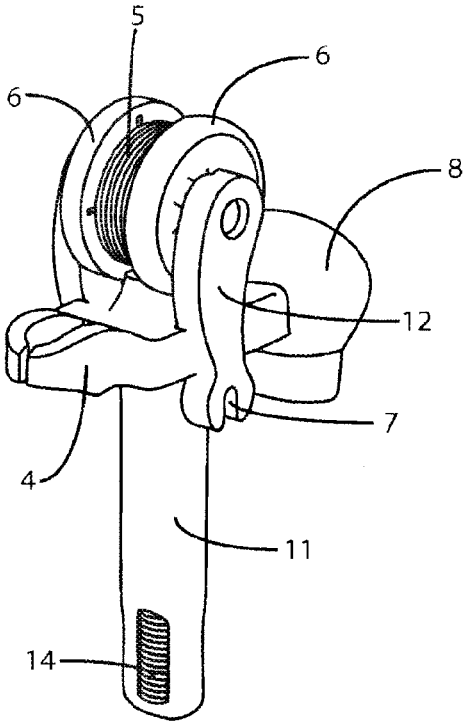
FIG. 5A shows a side view of the assembled lighting and valve opening subset according to a first embodiment of the present invention.
Figure 5B:
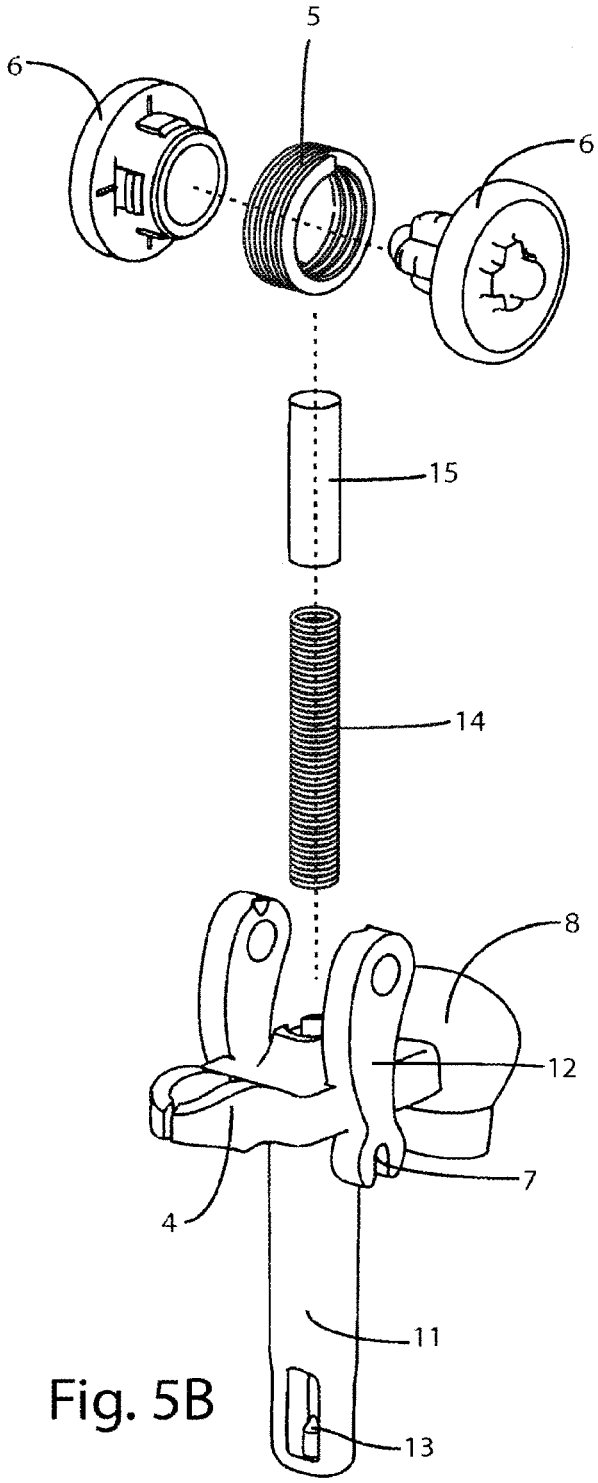
FIG. 5B shows an exploded side view of the lighting and valve opening subset according to a first embodiment of the present invention.

FIGS. 1-5B show a first embodiment of a lighter for the present invention. FIGS. 1-3 show the lighter in different positions, e.g., FIG. 1 shows the lighter in a rest position, FIG. 2 shows the lighter in an intermediate position, and FIG. 3 shows the lighter in a final lighting position. FIGS. 4A, 4B, 5A and 5B show the lighting and valve opening features of the ignition system in different views including a cross-sectional view in FIG. 4B and an exploded view in FIG. 5B. Each of these figures show features included in the first embodiment of the present invention. For example, reference numeral 1 shows a fuel reservoir; reference numeral 2 shows an opening/closing valve that allows gas to be emitted when opened and to be contained in the reservoir when the valve is closed; reference numeral 3 shows the head of the valve 2 where the gas is emitted and ignited; reference numeral 4 shows the fork, as best shown in FIGS. 5A and 5B, that includes an opening that allows a valve stem to pass through the opening, the fork, as also shown in FIGS. 2 and 3, operates on a lower shoulder of the head 3 of the valve 2 to open the valve 2; reference numeral 5 shows the spark wheel, best shown in FIG. 5B; reference numeral 6 shows the cheeks, best shown in FIG. 5B showing preferably two cheeks disposed on both sides of the spark wheel 5, with one cheek 6 preferably having a male connection on an interior side as shown and the other cheek 6 having a female connection on an interior side as shown; reference numeral 7 shows an axis that the ignition system rotates around; reference numeral 8 shows the push button that is connected to the fork 4 for opening and closing the valve 2; reference numeral 9 shows the hood that covers the spark wheel 5 and cheeks 6 when the lighter is in the rest position as shown in FIG. 1; reference numeral 10 shows a spring connected to the push button 8; reference numeral 11 shows the external generally cylindrical sleeve that holds the spring 14; reference numeral 12 shows the support arms that connect the spark wheel 5/cheeks 6 assembly to the sleeve 11, i.e., the arms 12 include pivots, preferably split pivots as shown in FIG. 4A, at their base which cooperate with cylindrical bearings (not shown) inside the body of lighter to ensure the swing of the lighting system around axis 7; reference numeral 13 shows a pin (best shown in FIGS. 4B and 5B) or securing assembly to hold the spring 14 in place when the spring 14 is disposed inside the sleeve 11; reference numeral 14 shows the spring 14 disposed inside the sleeve 11; and reference numeral 15 shows the flint stone where one end abuts the spring 14 and the other end comes into contact with the spark wheel 5.

Now that we have an understanding of the features shown in the first embodiment, we will now explain the operation of the lighter according to the present invention. In an initial rest position as shown in FIG. 1, the spark wheel 5 and cheeks 6 are disposed entirely inside hood 9, at a given distance below the upper level of the hood 9; the spark wheel 5 and cheeks 6 are maintained in this position by the force of the spring 10 acting under push button 8 as shown in FIG. 1.

The first stage of lighting includes applying a vertical radial force with a finger to the top of the hood 9 so that the pulp of the finger of an adult, after deformation between the two higher edges of the hood 9, reaches the periphery of the spark wheel 5 or the cheeks 6 and ensures a sufficient pressure to it. By a horizontal movement H1 of the finger thus supported on the top of the hood 9 with the pulp of the finger on the top of the spark wheel 5, the horizontal movement H1 extracts the spark wheel 5 from its retracted position to be in a partially released position, shown in FIG. 2, in which the periphery of the spark wheel 5 and cheeks 6 protrude from the hood 9. This extraction movement of the spark wheel 5 is obtained by the swing of the lighting-gas opening subset around the axis of swing 7, without releasing gas as a result of the functional play "d" between the upper end of fork 4 and the lower part/shoulder of the head 3 of the valve 2.

If a rotation force is exerted on the cheeks 6 according to a movement R2 (shown in FIG. 2), while maintaining a sufficient radial force, this allows the rotation of the spark wheel 5 around its axis and thus the generation of a shower of sparks directed to the gas outlet 3 of the jet from the valve 2. This rotational movement is preferably followed immediately by the fall of the finger on the push button 8 according to a vertical movement V3 (shown in FIG. 3), leading to an additional swing of the lighting-gas opening system around its axis of swing 7, this last portion of swing being accompanied by the rising of the gas opening jet by the action of fork 4 upon the shoulder of head 3.

FIG. 1-3 show the rotation of the spark wheel 5, cheeks 6, sleeve 11 and related components in relation to axis 7. As shown in FIG. 1 and described above, the spark wheel 5 and cheeks 6 are disposed in a forward position inside the hood 9 when the lighter is in the rest position, and the sleeve 11 is disposed in an aft position. FIG. 2 shows the lighter in an intermediate vertically upright position, with the periphery of the spark wheel 5 and cheeks 6 protruding from the hood 9 and the sleeve 11 also aligned in a vertically upright position as a result of its rotation around axis 7. FIG. 3 shows the lighter in a final lighting position, where the spark wheel 5 and cheeks 6 are disposed in an aft position and the sleeve 11 being disposed in a forward position.

The preferred design of the lighter as shown in FIGS. 1-3 allows the ignition system to be less visible by and accessible to children therefore making it more difficult for children to use the lighter. A person of ordinary skill in the art will understand that as used herein a hood disposed "completely" over the spark wheel 5 and cheeks 6 means that the spark wheel 5 and cheeks 6 are disposed inside the hood 9 as viewed from the side of the lighter shown in FIG. 1 where the outer boundary of the cheeks 6 is disposed inside the outer boundary of the hood 9. Similarly, a person of ordinary skill in the art will understand that as used herein a hood disposed "partially" over the spark wheel 5 and cheeks 6 means that the spark wheel 5 and cheeks 6 are disposed partially outside the outer boundary of the hood 9 as shown in FIGS. 2 and 3, where the outer boundary of the cheeks 6 is disposed partially outside the outer boundary of the hood 9. A person of ordinary skill in the art looking at the lighter shown in FIG. 1 from the top or the front of the lighter, e.g., in front of push button 8, will be able to see the spark wheel 5 and cheeks 6 to access and extract them to start the ignition process.

The present invention according to the first embodiment as shown in FIGS. 1-3 also makes it possible to provide an ignition subset as shown in FIGS. 4A, 4B, 5A and 5B. The ignition subset preferably includes all the components shown in FIGS. 4A, 4B, 5A and 5B but may also include other features known in the art. An advantage of such a system is it provides an ignition system and gas opening system that are independent of the gas reservoir. In addition, this system enables a person of ordinary skill in the art to assemble the ignition subset prior to the final assembly of the lighter. Moreover, the ignition subset shown in these figures integrates both functions of lighting and gas opening when the ignition subset is assembled to swing or rotate about an axis 7 and otherwise rotate in relation to the body and the reservoir 1 of the lighter.

The ignition subset shown in FIGS. 4A and 4B includes an overall structure generally having the shape of a cross. As shown in FIG. 5A, the spark wheel 5 is disposed in between the cheeks 6, with each cheek 6 shown in FIG. 5B being capable of being connected together and to the spark wheel 5 so that spinning of the cheeks 6 effect a spinning of the spark wheel 5. When the push button 8 is pushed down as shown in FIG. 3 such action brings the flint stone 15 in contact with the rotating spark wheel 5 to bring about the shower of sparks to light the gas being emitted from opened valve 2. The ignition subset shown in FIGS. 4A, 5A and 5B include arms 12 that support the spark wheel 5 and cheeks 6, and include a preferably split pivot connection shown in FIG. 4*a* that allow the ignition subset to snap onto or connect to the cylindrical bearings disposed on the reservoir body. This pivoting connection allows the ignition subset to rotate about the axis 7 and provide the benefits of making the spark wheel 5 and cheeks 6 less accessible to children when the lighter is in the rest position shown in FIG. 1. A preferred shape of the arms 12 is shown in FIG. 4A and includes arms 12 generally having a crescent-wrench shape with the head of the wrench including the split pivots as shown to connect the arms 12 to known in the art bearings disposed on the reservoir body. On the other end of the arms 12 or end connected to the cheeks 6, means known in the art are provided to allow the cheeks 6 to connect to the arms 12. A person of ordinary skill in the art will readily understand that other means may be used to connect the arms 12 to the reservoir body to allow the ignition subset to rotate around axis 7. A person of ordinary skill in the art will understand that the complete lighting and valve opening subset as shown in FIGS. 4A, 4B, 5A and 5B is capable of pivoting around axis 7 not just the spark wheel itself. In addition, a person of ordinary skill in the art will also understand that the fork 4, push button 8, arms 12 and sleeve 11 are shown as one unit; however, these features do not have to be manufactured as one component, i.e., they may be separate components that are separately connected to form the desired assembly. When assembled, the lighting subset is placed in a cavity of the reservoir so that it can rotate around an axis 7.

Figure 7:
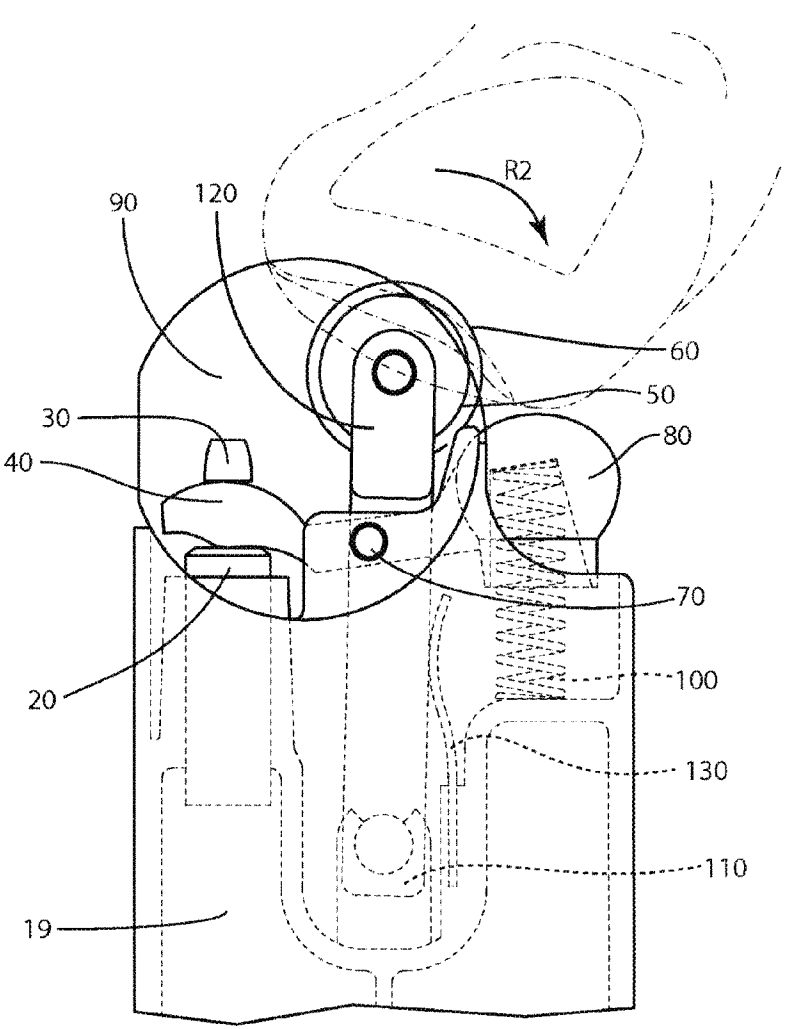
FIG. 7 shows a side view of a lighter according to a second embodiment of the present invention where the lighter is in its intermediate position in the course of lighting.
Figure 6:
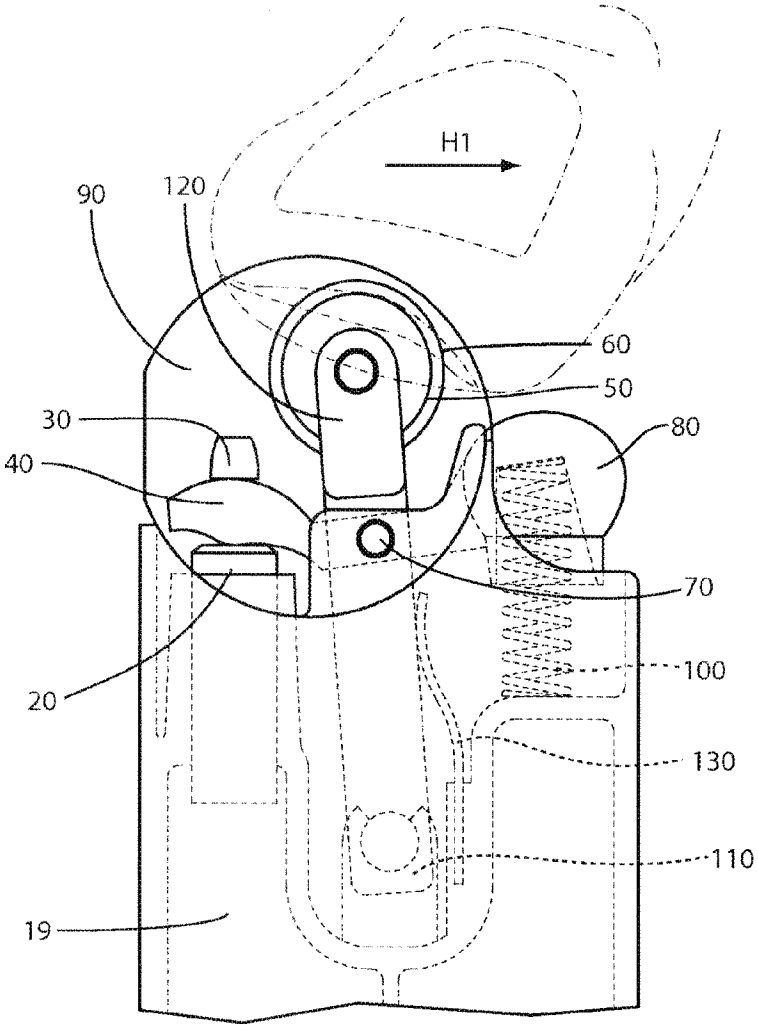
FIG. 6 shows a side view of a lighter according to a second embodiment of the present invention where the lighter is in its rest position and the spark wheel is inside the hood.
Figure 8:
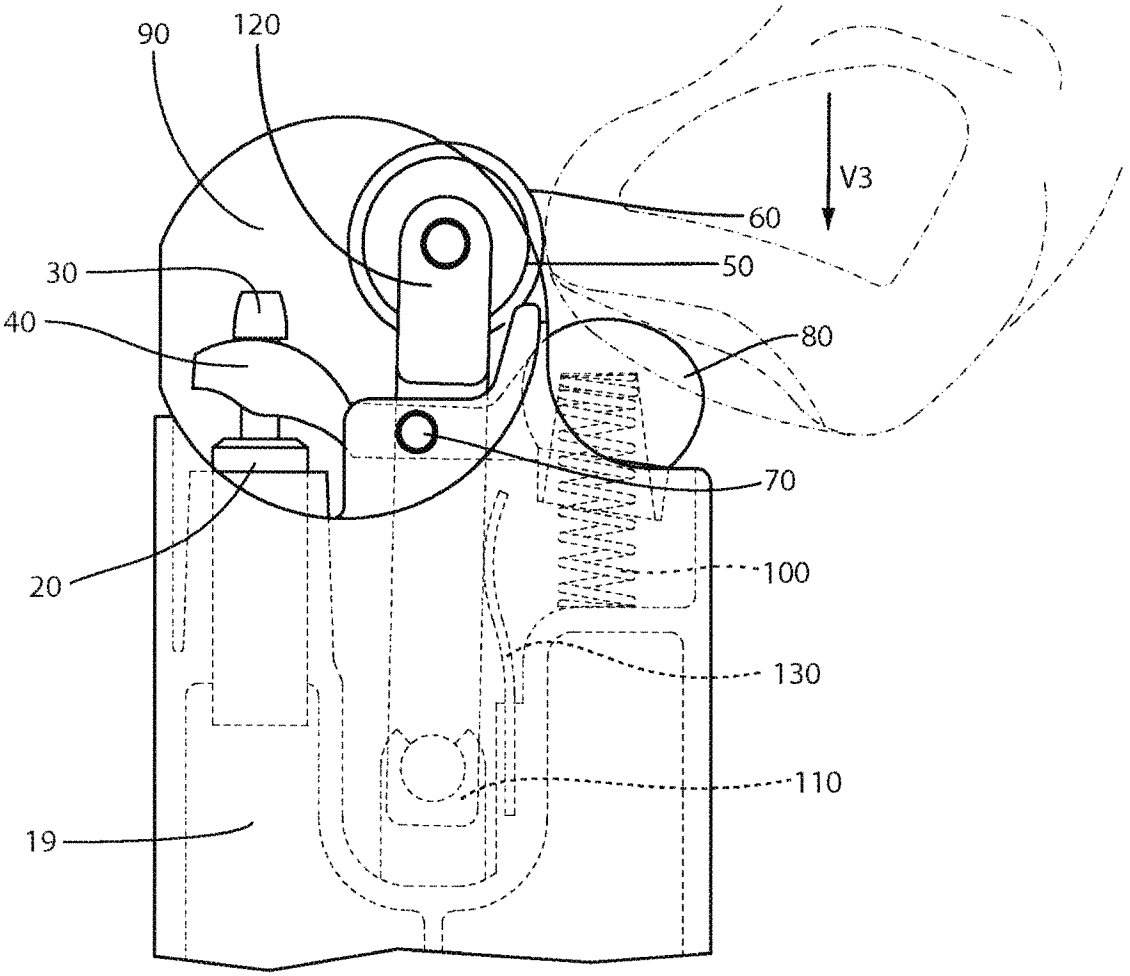
FIG. 8 shows a side view of a lighter according to a second embodiment of the present invention where the lighter is in its final position in the course of lighting, where the action of the thumb maintains the flame after lighting and the spark wheel is at the beginning of return towards its resting position.

A second embodiment of the present invention includes features in common with the first embodiment. For example, the second embodiment of the present invention includes a fuel reservoir 19, opening/closing valve 20, a head 30 of the valve 20, fork 40, spark wheel 50, cheeks 60, push button 80, hood 90, spring 100, and arms 120. In addition, FIGS. 6-8 are similar to FIGS. 1-3 as FIG. 6 shows a lighter in its rest position, with the spark wheel 50 inside the hood 90, FIG. 7 shows a lighter in the intermediate position, with the spark wheel 50 in position out of hood 90, and FIG. 8 shows a lighter in its position of maintaining the flame after lighting, with the spark wheel 50 at the beginning of return towards its retracted position under the effect of the spring 100, for the holding action according to the force V3 shown in FIG. 8 ensures valve 20 remains open. In addition, as shown in FIG. 6, the gas opening fork 40 pivots in a conventional way around an axis materialized on the fork 40 by pivots in freedom of rotation in cylindrical bearings 70.

In an initial rest position as shown in FIG. 6, spark wheel 50 and its cheeks 60 are entirely disposed inside hood 90, at a given distance below the upper level of the hood 90. The spark wheel 50 and its cheeks 60 are maintained in this position as a result of the action of spring 100, in which the spring 100 has an end preferably connected to a wall of the reservoir body and another end connected to the push button 80. In addition, the second embodiment of the present invention includes a leaf spring 130 having one end preferably disposed in a reservoir wall and a second end that acts against the sleeve 110 thereby making it more difficult for a child to extract the spark wheel 50 and cheeks 60 from the hood 90. As shown in FIGS. 6-8, the leaf spring 130 is disposed adjacent to spring 100 and acts in tandem with spring 100. The lighting subset includes a hollow cylindrical sleeve 110 containing the flint stone spring (not shown) and the flint stone (not shown) compressed against the spark wheel 50. The lighting subset rotates freely around an axis of rotation for the spark wheel 50 and cheeks 60 materialized by cylindrical bearings disposed in the arms 120 providing this hollow support. The lighting subset is placed in a cavity of the reservoir so that it can swivel around an axis of swing from an initial position in which, under the action of the spring 100 and leaf spring 130, it maintains the cheeks 60—spark wheel 50 subset entirely inside the hood 90, to a back position in which the subset—spark wheel 50 cheek 60 is extracted partially out of the hood 90.

In the second embodiment of the present invention, the first stage of lighting includes applying a vertical radial force with a finger to the top of the hood 90 so that the pulp of the finger of an adult, after deformation between the two higher edges of the hood 90, reaches the periphery of the spark wheel 50 or the cheeks 60 and ensures a sufficient pressure to it. By a horizontal movement H1 FIG. 6) of the finger thus supported on the top of the hood 90 with the pulp of the finger on the top of the spark wheel 50, the spark wheel 50 and cheeks 60 are extracted from their retracted position shown in FIG. 6 to be in a partially released position, with the periphery of the spark wheel 50 and cheeks 60 protruding from the hood 90 as shown in FIG. 7. This extraction of the spark wheel 50 is obtained by the back swing of the lighting subset in its cavity around its axis.

When a rotational force is exerted on the cheeks 60 according to a movement R2 FIG. 7), while maintaining a sufficient radial force, this allows the rotation of the spark wheel 50 around its axis and thus the generation of a shower of sparks in direction of the gas outlet from the head 30 of valve 20. This rotational movement is followed immediately by the fall of the finger on the pusher of the fork 40 according to a vertical movement V3 FIG. 8), leading to the rotation of the fork 40 around its axis, this action being accompanied by the rising of the gas opening jet by the action of the fork 40 on the shoulder of the head 30. During this vertical movement V3, the lighting subset returns in its initial position under the action of the spring 100 and leaf spring 130 which urges the spark wheel 50 and cheeks 60 back into their initial, retracted position under the hood 90.

Figure 9:
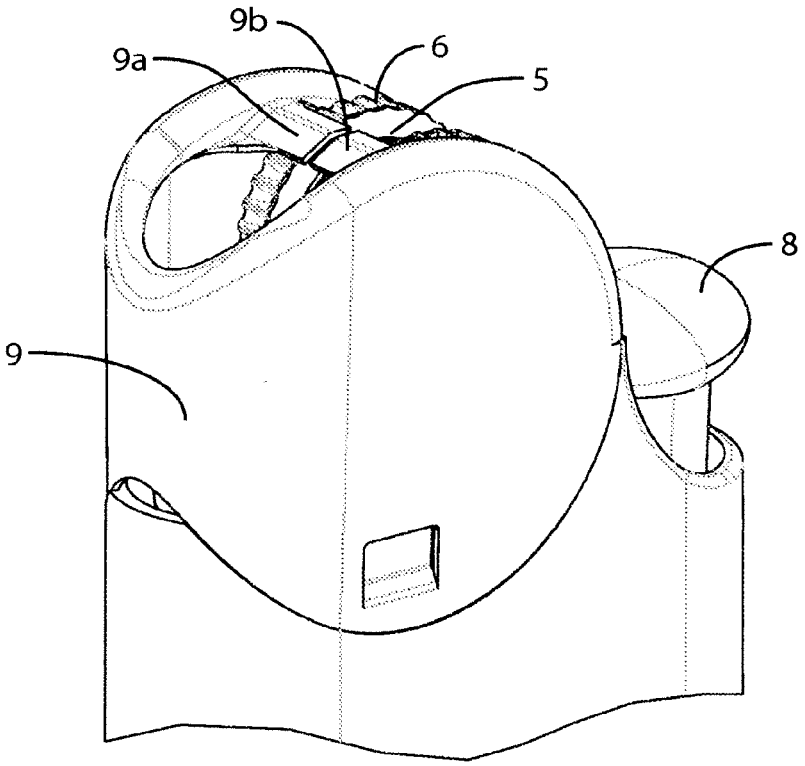
FIG. 9 shows a top view of an upper section of a lighter according to an embodiment of the present invention, showing the hood of the lighter and specific features related to non-deformable ignition subset access minimization ribs.
Figure 10:
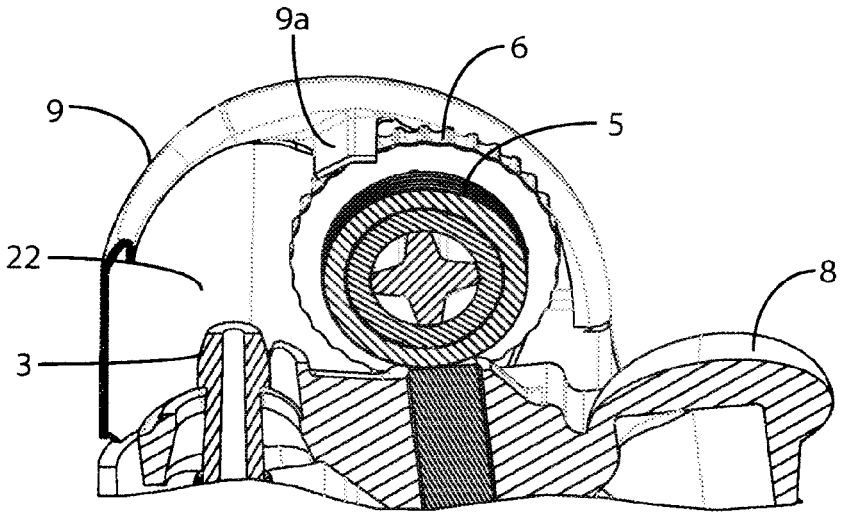
FIG. 10 shows a cut-out section of the lighter's hood and other features of the lighter shown in FIG. 9.

FIGS. 9 and 10 show another embodiment of the present invention, focused on a preferred design of the lighter's hood 9 to render the extraction of the spark wheel 5 and cheeks 6, and further rotation of the spark wheel 5, more difficult by a child without affecting the operation of the lighter by an adult. In an initial rest position as shown in FIGS. 9 and 10, the spark wheel 5 and cheeks 6 are disposed completely inside hood 9, at a given distance below the upper level of the hood 9. In order to prevent a child from introducing its finger inside the hood 9 in the portion above the outlet of gas 22, non-deformable access minimization ribs 9*a* and 9*b*, extending from sides of the hood 9 as shown on FIGS. 9 and 10, preferably partially covering the front, upper portion of the cheeks 6 on the side of the gas outlet 3 making such front upper section inaccessible to a user's finger. The non-deformable access minimization ribs 9*a* and 9*b* preferably extend transversally above the front portion of the periphery of the cheeks 6 as shown in FIGS. 9 and 10 so that the access minimization ribs 9*a*, 9*b* partially cover the front, upper portion of the cheeks 6 on the side of the gas outlet to limit the access by children to the ignition subset. When extended transversely, the access minimization ribs 9*a* and 9*b*, when separate as shown in FIG. 9, extend at least above the spark wheel 5 and over the upper portion of the cheek 6. Furthermore, the shape of each access minimization rib 9*a*, 9*b* may include the shape shown in FIGS. 9 and 10, i.e., a generally rectangular shape having a lower side (not shown) having a generally concave shape that corresponds to the shape of the outer periphery of the cheeks 6. In addition, non-deformable access minimization ribs 9*a* and 9*b* are shown in FIG. 9 as two separate ears; however, the scope of the invention includes one non-deformable access minimization rib that includes a solid rectangular structure from one side of the hood 9 to the other side of the hood 9, not including a break in the element as shown in FIG. 9. In addition, the scope of the invention also includes non-deformable access minimization ribs 9*a* and 9*b* that have other shapes and configurations as long as such shape extends transversely above the front portion of the periphery of the cheeks.

Figure 11:
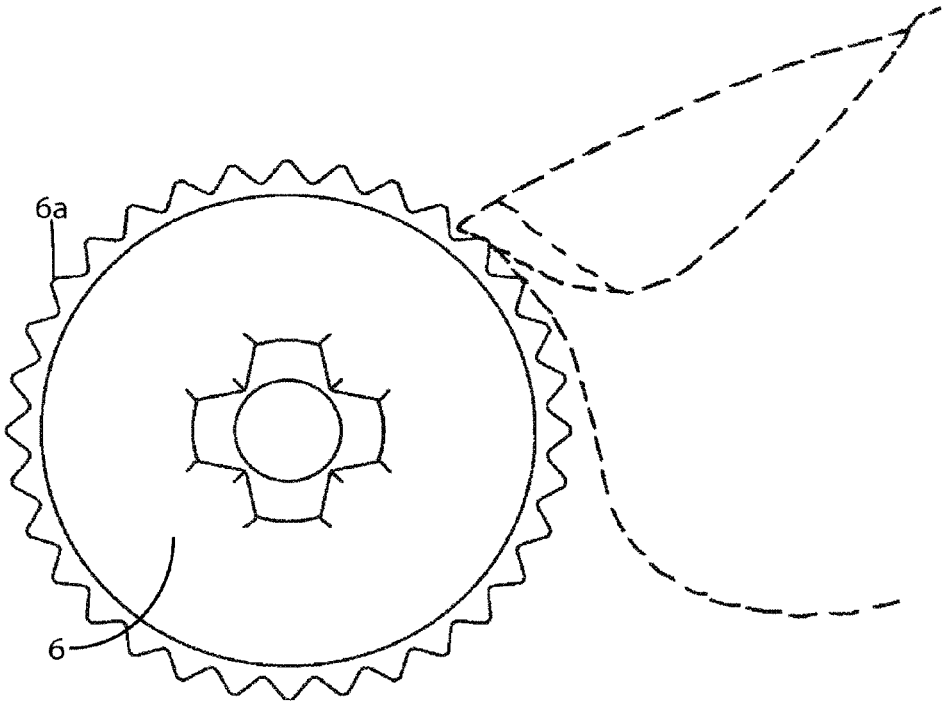
Fig. 11 PRIOR ART
FIG. 11 shows a side view of a cheek and the shape of its periphery as known in the art.
Figure 12:
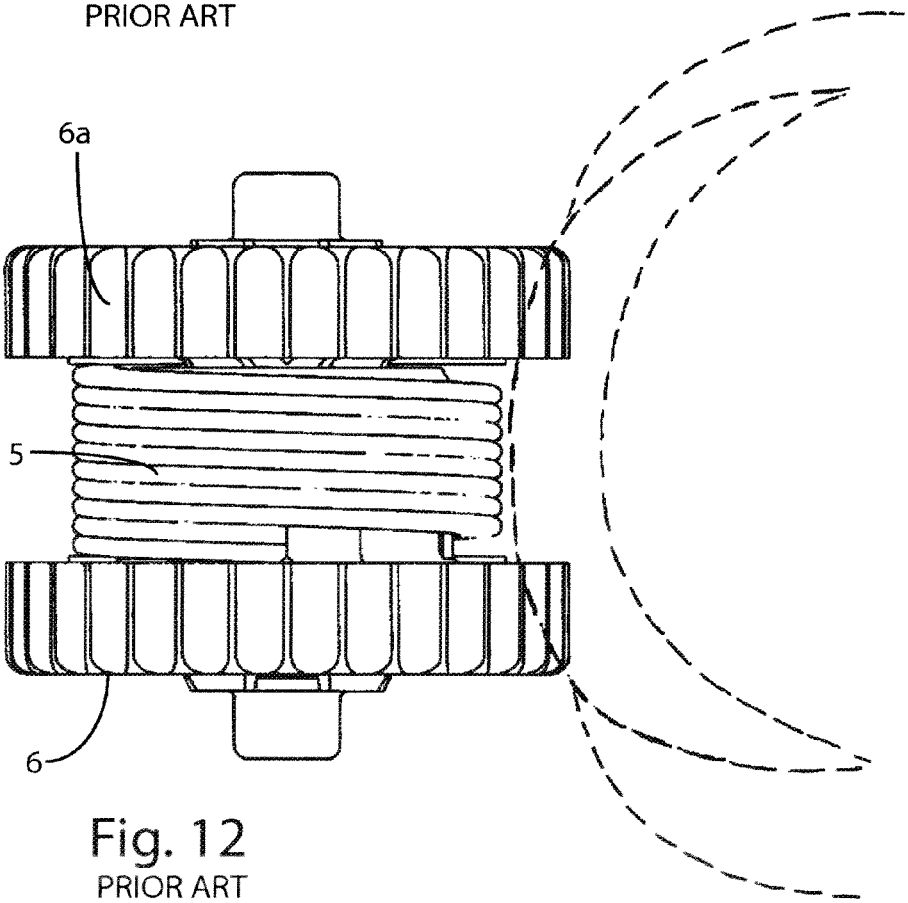
Fig. 12 PRIOR ART
FIG. 12 shows a top view of cheeks connected to a spark wheel as known in the art.
Figure 13:
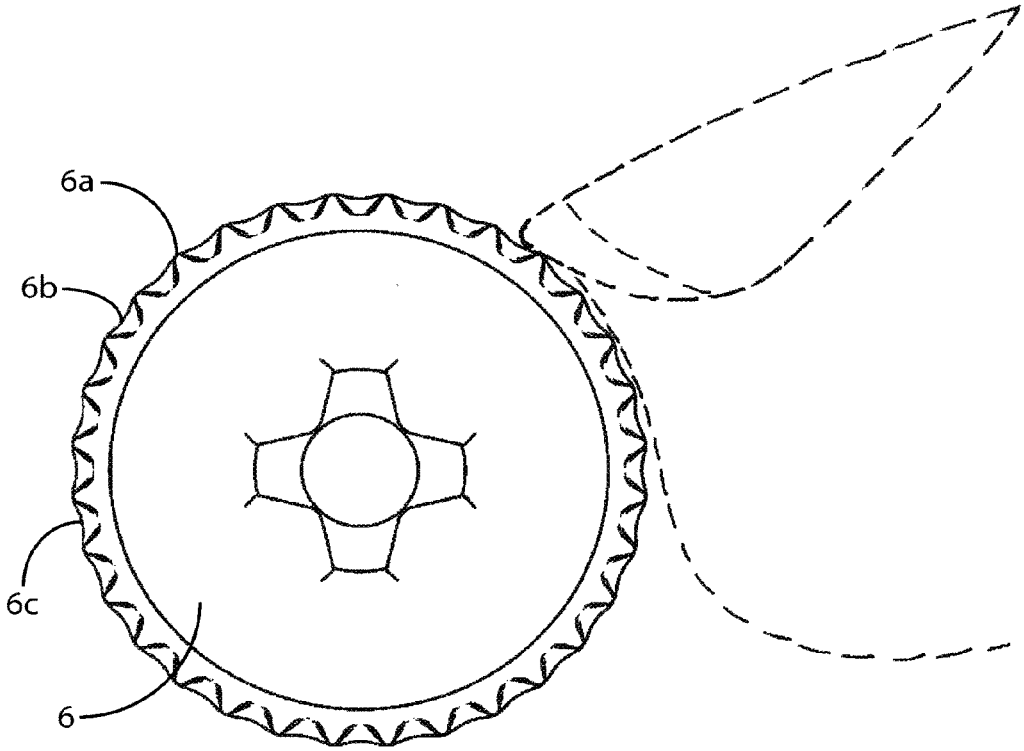
FIG. 13 shows a side view of a cheek and the shape of its periphery according to an embodiment of the present invention.
Figure 14:
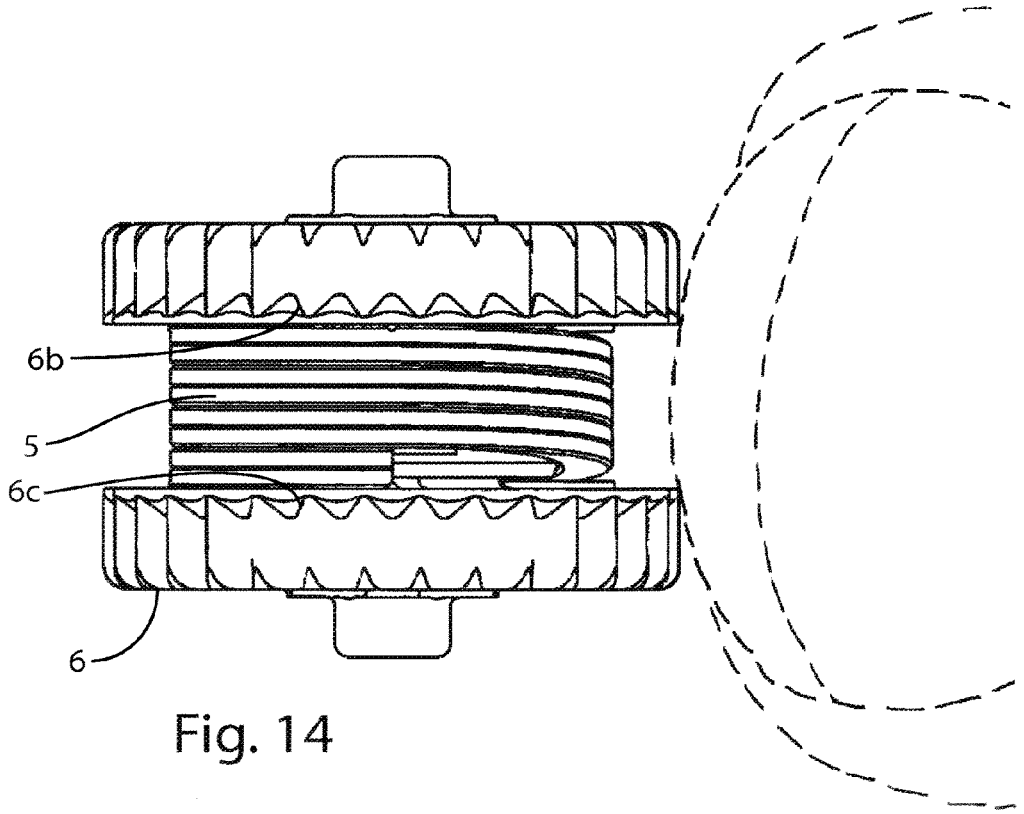
FIG. 14 shows a top view of cheeks connected to a spark wheel according to an embodiment of the present invention.

FIGS. 11-14 show features related to another embodiment of the present invention, with FIGS. 11 and 12 including features related to the design of the periphery of the cheeks 6 as known in the art, and FIGS. 13 and 14 showing features related to the design of the periphery of the cheeks according to an embodiment of the present invention. The features showed in FIGS. 13 and 14 show features that render the extraction and further rotation of the ignition subset more difficult by a child without affecting the operation of the lighter by an adult.

As known in the art, the cheeks 6 shown in FIG. 11 have an outer diameter greater than the spark wheel 5 and the peripheries of the cheeks 6 are typically of the serrated type, where each tooth 6*a* includes a triangular section shown in FIG. 11 and a length extending from one tooth 6*a* to the adjoining tooth 6*a*, over the entire circumference of the cheek 6. Such cheeks shown in FIGS. 11 and 12 improve the tangential action of the pulp of the finger of an adult that allows an adult to extract and/or rotate the spark wheel 5. In a lighter of the present invention having the spark wheel 5 disposed completely or partially inside the hood, one way for a child to rotate the ignition subset would be to introduce the nail of one of his fingers in between the teeth 6*a* of the cheeks 6 as shown in FIG. 11.

An embodiment of the present invention provides means shown in FIGS. 13 and 14 for preventing the nail of a child from reaching and getting a grip on the asperities at the periphery of the cheeks 6. Each tooth 6*a* of the cheek 6 is connected to the next by a narrow rib 6*b* having a width equal to the length from one tooth to the adjacent tooth's vertical leg at a point below the peak of the tooth 6*a*, but having an elevation almost identical to the elevation of the tooth 6*a*. A preferred embodiment includes a rib 6*b* that is slightly curved forming an overall cheek anti-grip rib 6*c* around the entire periphery of the cheek 6 preferably located on the spark wheel 5 side of each cheek. Such a design decreases a child's ability to grip the inner ring of the cheek 6. The preferred embodiment for the rib 6*b* is best shown in FIG. 14, which shows the cheek anti-grip rib 6*c* located only on the spark wheel 5 side of each cheek 6 and having an elevation almost identical to the elevation of the tooth 6*a*. Other embodiments of the rib 6*c* may include ribs that traverse the entire width of the tooth, where each rib preferably includes a concave shape, or ribs 6*b* descending in height from an interior to an exterior side of the cheek or from an exterior to an interior side of the cheek 6. FIG. 13 shows a preferred design of the cheek 6 having approximately 32 teeth, separated by ribs 6*b*. A person of ordinary skill in the art will readily understand that the design may include more than or less than 32 teeth, have teeth with different heights and types of ribs.

A person of ordinary skill in the art will understand that the aspects of the present invention are not limited to the features in the specification as described above or shown in the drawings. The specification is written to enable a person of ordinary skill in the art to make and use the aspects of the present invention, without undue experimentation; however, the specification is not written to limit the scope of the embodiments of the present invention.

A person of ordinary skill in the art would appreciate that the following features can be used either alone, partially grouped, or fully combined:

In an initial rest position for the lighter, the hood (9, 90) is disposed completely over the cheeks (6, 60).

When the lighter is in operation from an initial rest position to a final lighting position, the spark wheel (5, 50), cheeks (6, 60) and sleeve (11, 110) rotate relative to the reservoir (1, 19).

The valve actuator (4), the first spring (10), the spark wheel (5), the cheeks (6), the support arms (12), the sleeve (11), the second spring (14), and the flint stone (15) are an integral unit. Alternatively, an ignition system including the spark wheel (50), cheek (60), sleeve (110), second spring (14) and flint stone (15) are independent of the gas opening system including the valve actuator (40) and the valve (20).

The lighter according to any of preceding claims, wherein in the initial rest position, from a side view of the lighter, the spark wheel (5, 50) and cheeks (6, 60) are not visible under the hood.

The lighter according to any of preceding claims, wherein in a final lighting position for the lighter, the hood (9, 90) is disposed partially over the cheeks (6, 60), and the push button (8, 80) is depressed.

The pivoting connection includes a split pivot connection.

In the initial rest position, the flint stone (15) is not in contact with the spark wheel.

In an intermediate position for the lighter, the hood (9, 90) is disposed partially over the cheeks (6, 60).

The cheeks (6, 60) include a plurality of teeth (6*a*) around the periphery, where each tooth is connected to an adjacent tooth by a rib (6*b*, 6*c*) disposed on an interior edge of the cheek.

Each rib (6*b*, 6*c*) includes a concave shape.

Each rib (6*b*, 6*c*) has a height approximately equal to the height of each tooth (6*a*).

The hood includes an access minimization member extending transversely from one side to the other side of the hood (9) to cover an upper portion of the cheeks (6).

The access minimization member covers a front upper portion of the cheeks (6) on the side of the gas outlet (22).

The access minimization member includes one member having a generally rectangular shape extending from one side of the hood to the other side of the hood.

The access minimization member includes at least two members (9*a*, 9*b*), each member having a general rectangular shape extending from one side of the hood but not connected to the other member.

The first spring (10, 100) is biased against a lower surface of a push button actuator.

The flammable gas includes liquefied petroleum gas.

In the initial rest position, the push button (8, 80) is not depressed and the valve (2, 20) is in a closed position.

The final lighting position, the valve (2, 20) is in an open position.

In the initial rest position, the first spring (10,100) is in an extended state.

In the final lighting position, the first spring (10, 100) is in a compressed state.

In the final lighting position, the flint stone (15) is in contact with the spark wheel (5, 50).

The invention claimed is:

1. A gas lighter with a child safety feature comprising:

a reservoir for holding a flammable gas;

a valve mounted on a top surface of the reservoir for allowing a release of the gas from the reservoir;

a valve actuator having a push button disposed on a first end and a connection assembly disposed on a second end for connecting the valve actuator to the valve;

a first spring biased against a lower surface of the push button and a wall of the reservoir;

a spark wheel coaxially mounted with at least two cheeks capable of rotating;

a sleeve disposed under the spark wheel;

a second spring fully housed disposed in the sleeve;

a flint stone disposed in the sleeve, on a top surface of the second spring;

a hood disposed completely or partially over the cheeks; and at least two support arms, each arm having a first end coaxially mounted with the cheeks and a second end having a pivoting connection to bearings disposed on the reservoir, wherein in an initial rest position for the lighter, the cheeks are disposed inside the hood as viewed from the side of the lighter, and wherein the at least two support arms and the sleeve are part of a subset pivotally mounted on the reservoir around an axis.

2. The lighter according to claim 1, in which in the initial rest position for the lighter, the hood is disposed completely over the cheeks.

3. The lighter according to claim 1, wherein when the lighter is in operation from an initial rest position to a final lighting position, the spark wheel, cheeks and sleeve rotate relative to the reservoir.

4. The lighter according to claim 1, wherein the valve actuator, the first spring, the spark wheel, the cheeks, the support arms, the sleeve, the second spring, and the flint stone are an integral unit.

5. The lighter according to claim 1, wherein an ignition system including the spark wheel, cheek, sleeve, second spring and flint stone are independent of the gas opening system including the valve actuator and the valve.

6. The lighter according to claim 1, wherein in the initial rest position, from a side view of the lighter, the spark wheel and cheeks are not visible under the hood.

7. The lighter according to claim 1, wherein in a final lighting position for the lighter, the hood is disposed partially over the cheeks, and the push button is depressed.

8. The lighter according to claim 1, wherein the pivoting connection includes a split pivot connection.

9. The lighter according to claim 1, wherein in an intermediate position for the lighter, the hood is disposed partially over the cheeks.

10. The lighter according to claim 1, wherein the cheeks include a plurality of teeth around the periphery, where each tooth is connected to an adjacent tooth by a rib disposed on an interior edge of the cheek.

11. The lighter according to claim 10, wherein each rib includes a concave shape.

12. The lighter according to claim 10, wherein each rib has a height approximately equal to the height of each tooth.

13. The lighter according claim 1, wherein the hood includes an access minimization member extending transversely from one side to the other side of the hood to cover an upper portion of the cheeks.

14. The lighter according to claim 13, wherein the access minimization member covers a front upper portion of the cheeks, on the side of the gas outlet.

15. The lighter according to claim 13, wherein the access minimization member includes one member having a generally rectangular shape extending from one side of the hood to the other side of the hood.

16. The lighter according to claim 13, wherein the access minimization member includes at least two members, each member having a general rectangular shape extending from one side of the hood but not connected to the other member.

17. The lighter according to claim 1, wherein the first spring is biased against a lower surface of a push button actuator.

18. The lighter according to claim 1, wherein the flammable gas includes liquefied petroleum gas.

19. The lighter according to claim 1, wherein in the initial rest position, the push button is not depressed and the valve is in a closed position.

20. The lighter according to claim 1, wherein in the final lighting position, the valve is in an open position.

21. The lighter according to claim 1, wherein in the initial rest position, the first spring is in an extended state.

22. The lighter according to claim 1, wherein in the final lighting position, the first spring is in a compressed state.

23. The lighter according to claim 1, wherein in the final lighting position, the flint stone is in contact with the spark wheel.

* * * * *